US010256052B2

(12) United States Patent
Seo

(10) Patent No.: US 10,256,052 B2
(45) Date of Patent: Apr. 9, 2019

(54) INTEGRATED INTERLOCK DEVICE OF AIR CIRCUIT BREAKER AND METHOD OF USING THE SAME

(71) Applicant: LSIS CO., LTD., Anyang-si, Gyeonggi-do (KR)

(72) Inventor: Jaekwan Seo, Anyang-si (KR)

(73) Assignee: LSIS CO., LTD., Anyan-Si, Gyeonggi-Do (KR)

( * ) Notice: Subject to any disclaimer, the term of this patent is extended or adjusted under 35 U.S.C. 154(b) by 0 days.

(21) Appl. No.: 15/611,675

(22) Filed: Jun. 1, 2017

(65) Prior Publication Data

US 2018/0122594 A1 May 3, 2018

(30) Foreign Application Priority Data

Nov. 2, 2016 (KR) ..... 10-2016-0145354

(51) Int. Cl.
*H01H 9/26* (2006.01)
*H01H 9/22* (2006.01)

(52) U.S. Cl.
CPC ..... *H01H 9/262* (2013.01); *H01H 9/22* (2013.01)

(58) Field of Classification Search
CPC ..... H01H 9/262; H01H 3/36; H01H 33/6661; H01H 33/6662; H01H 2009/265; H01H 21/06; H01H 9/20; H01H 9/26; H01H 2300/018; H01H 11/0018; H01H 11/041; H01H 19/02; H01H 3/3021
USPC ... 200/293, 325, 43.19, 51.09, 50.01, 50.02, 200/50.12, 50.28, 51.07, 50.3, 50.32, 200/50.33
See application file for complete search history.

(56) References Cited

U.S. PATENT DOCUMENTS

| | | | |
|---|---|---|---|
| 5,726,401 | A | 3/1998 | Green et al. |
| 6,225,581 | B1 | 5/2001 | Gerbert-Gaillard et al. |
| 8,692,143 | B2 | 4/2014 | Schneider |

FOREIGN PATENT DOCUMENTS

| | | | |
|---|---|---|---|
| CN | 103578811A | A | 2/2014 |
| DE | 102008007987 | B3 | 5/2009 |
| EP | 1150316 | A1 | 10/2001 |
| JP | 2003308764 | A | 10/2003 |
| KR | 200183457 | | 3/2000 |
| KR | 20030075039 | A | 9/2003 |
| KR | 100469366 | | 2/2005 |
| KR | 101345173 | | 12/2013 |
| KR | 20160037619 | | 4/2016 |

OTHER PUBLICATIONS

Korean Intellectual Property Office Search report dated Aug. 17, 2016, 6 pages.
Korean Office Action for related Korean Application No. 10-2016-0145354; action dated Nov. 29, 2017; (6 pages).
European Search Report for related European Application No. 17162808.4; report dated Oct. 25, 2017; (9 pages).
Chinese Office Action issued on Oct. 26, 2018 in corresponding Chinese Patent Application No. 201710613885.6 (10 Pages).

*Primary Examiner* — Ahmed M Saeed
(74) *Attorney, Agent, or Firm* — K&L Gates LLP

(57) ABSTRACT

The present invention relates to an integrated interlock device of an air circuit breaker, and more particularly, to an integrated interlock device of an air circuit breaker capable of using different types of interlock devices in an integrated manner in case of using two or more air circuit breakers connected to each other, and a method of using the same.

16 Claims, 8 Drawing Sheets

INTEGRATED INTERLOCK DEVICE OF AIR CIRCUIT BREAKER AND METHOD OF USING THE SAME

CROSS-REFERENCE TO RELATED APPLICATION

Pursuant to 35 U.S.C. § 119(a), this application claims the benefit of earlier filing date of and right of priority to Korean Application No. 10-2016-0145354, filed on Nov. 2, 2016, the contents of which are all hereby incorporated by reference herein in its entirety.

BACKGROUND OF THE INVENTION

1. Field of the Invention

This specification relates to an integrated interlock device of an air circuit breaker, and a method of using the same, and more particularly, to an integrated interlock device of an air circuit breaker capable of using different types of interlock devices in an integrated manner in case of using two or more air circuit breakers connected to each other, and a method of using the same.

2. Background of the Invention

Generally, an aft circuit breaker is a kind of circuit breaker configured to open and closes a load at a power transmission site or a substation, or on an electric circuit, etc., or configured to cut off a current when an accident such as a ground connection (earthing) or a short-circuit occurs, and is mainly used for a low voltage device.

Such an air circuit breaker may be used in a state where two or more air circuit breakers are connected to each other for interaction. In this case, it is required to control an interaction of the plurality of air circuit breakers. For example, if a first circuit breaker is turned on, a second circuit breaker is turned off. Such an interaction may be extended to three or more air circuit breakers. As such an interaction, a method of controlling on-off operations of two or more circuit breakers by using cables has been widely used.

A door lock function may be provided to prevent a switchboard door from being open while a circuit breaker is being operated. Such a door lock function may be also performed by utilizing cables, if a switchgear door and a circuit breaker are far from each other.

However, in case of such an interlock device using cables, either a mechanical interlock or a switchboard door interlock should be selectively used.

For example, U.S. Pat. No. 6,225,581 'Installation comprising an Electrical Switchgear Apparatus and a Cable Interlock' may be referred to. A prior art thereof is shown in FIG. 1. The prior art relates to an apparatus in which a switching mechanism of one or more circuit breakers is interlocked with a mechanical interlock or a door by a power transmission cable.

This prior art includes a circuit breaker (not shown), a cable 138 and an interlock means 130. Here, the cable 138 is composed of a sheath 182 formed of a flexible material, and a core 186 slidable in the sheath 182. One end of the sheath is fixed to a frame 122 by a fixing means 120, and one end of the core 186 is fixed to the interlock means 130. The interlock means 130 includes an end part 194 that operates by interworking with a cable, and a housing 104 that accommodates the end part therein.

The interlock means 130, the fixing means 120 and the cable 138 are installed at a cradle (not shown) of one circuit breaker (first circuit breaker) in a connected state to each other, and installed at a cradle (not shown) of another circuit breaker (second circuit breaker) with a symmetric structure for interaction. That is, if the cable 138 is pulled as the first circuit breaker is turned on, the second circuit breaker is turned off by the pulled cable.

Such an interlock device connected to two circuit breakers is usually installed in a pair. Assuming that the above device is 'A', the same or similar device 'B' is installed close to the A. Here, the 'B' may be installed to perform an operation in an opposite direction to the 'A'. According to the 'B', when the second circuit breaker is turned on, the 'on' operation is transmitted to the first circuit breaker by a cable so that the first circuit breaker is turned off.

However, the conventional interlock device is configured to perform only one function of a mechanical interlock at two circuit breakers connected to each other. Even though such a function may be used by being converted into a door lock function, only one function may be performed.

In order to overcome such limitations, has been proposed an invention capable of using different interlock functions in an integrated manner. For example, Korean Patent Laid-Open No. 10-2016-0037619 'Interlock device for air circuit breaker' may be referred to. A prior art thereof is shown in FIG. 2. The prior art relates to an interlock device of an air circuit breaker capable of simultaneously performing a mechanical interlock function and a door interlock function.

The prior art includes a rotation pin 210 connected to a main shaft of an air circuit breaker and rotated according to a closing or interrupting operation of the circuit breaker; a first lever 220 having one end where a locking groove 221 for inserting the rotation pin 210 is formed such that the first lever 220 performs a rotary motion by the rotation pin 210, and having another end to which a first wire 230 is connected; a slider 250 installed to be spaced apart from the first lever 220, and connected to a second wire 235 to receive a force when another air circuit breaker performs a closing operation; and a lock member 270 coupled to a rotation shaft 222 of the first lever 220, and locked to a hooking member 285 provided at a switchboard panel door 280.

In the prior art, when the main shaft of a first circuit breaker is operated on an 'on' position, the rotation pin 210 is rotated about the main shaft and the first lever 220 is rotated by interaction. As a result, the lock member 270 installed at the rotation shaft 222 is rotated to restrict the switchboard panel door 280. On the other hand, when a second circuit breaker is operated on an 'on' position, the 'on' operation is transmitted through the second wire 235 to pull the slider 250 and to cause the first circuit breaker to be turned off by an operation lever 240 connected to the slider 250. Such a configuration is similar to the aforementioned prior art.

In summary, in the prior art, a mechanical interlock is carried out by using a cable, and a door lock function is carried out by a lock member separately installed at a rotating lever.

However, in the prior art, since a mounting plate 215, the switchgear panel door 280 and the lock member 270 should be connected to each other, there is a spatial limitation and the degree of freedom of design is reduced. In addition, an additional configuration different from a configuration using a cable should be implemented, an entire configuration becomes complicated.

Thus, it is necessary to use a plurality of interlock functions used at a circuit breaker such as a mechanical interlock function or a switchboard door interlock function, in an integrated manner.

SUMMARY OF THE INVENTION

Therefore, an aspect of the detailed description is to provide an integrated interlock device of an air circuit breaker capable of performing an interlock function through a power transmission using cables, in two or more circuit breakers connected to each other for interaction, and capable of using a plurality of interlock functions in an integrated manner, and a method of using the same.

To achieve these and other advantages and in accordance with the purpose of this specification, as embodied and broadly described herein, there is provided an integrated interlock device of an air circuit breaker, including: a mounting plate installed at part of a cradle or a switchboard; a bi-directional lever rotatably installed at the mounting plate, having a first arm and a second arm which are toward different directions on the basis of a first rotation shaft, and moved in a connected state to a main shaft of a circuit breaker body; a uni-directional lever rotatably installed at the mounting plate in a spaced state from the bi-directional lever, having a third arm which is toward one direction on the basis of a second rotation shaft, and moved in a connected state to an off lever of the circuit breaker body; first to third cables including sheaths and core members, and configured to transmit a power in a connected state to the first to third arms, respectively; and first to third connection openings spaced from the first to third arms, and configured to fix the sheaths of the first to third cables, respectively.

Each of the first to third arms may be provided with a pair of core holders for fixing a pair of core members of each of the first to third cables.

The first and second connection openings may be spaced from each other in opposite directions, on the basis of the bi-directional lever.

Each of the first to third connection openings may be provided with a pair of cable holes for fixing a pair of sheaths of each of the first to third cables.

Core holes for inserting the core members may be penetratingly-formed at the core holders, and core fixing holes may be formed at one side of the core holes in a direction perpendicular to the core holes.

Sheath fixing holes may be penetratingly-formed at one side of the cable holes, in a direction perpendicular to the cable holes.

Coupling means may be provided to fix the core members or the sheaths by being inserted into the core fixing holes or the sheath fixing holes.

The coupling means may include a bolt and a nut.

A locking lever, rotated in a connected state to a shaft lever of the circuit breaker body, may be provided on a rear surface of the bi-directional lever. And a transmission lever, rotated in a connected state to the off lever of the circuit breaker body, may be provided on a rear surface of the uni-directional lever.

First and second insertion holes, configured to insert the locking lever and the transmission lever, respectively, may be formed at a side plate of the cradle. A plurality of assembly holes for insertion-installation of the mounting plate may be formed at the side plate, and mounting pins inserted into the assembly holes may be provided on a rear surface of the mounting plate.

The mounting plate may be provided with operation holes for operating core holders by inserting part of the core holders.

To achieve these and other advantages and in accordance with the purpose of this specification, as embodied and broadly described herein, there is also provided a method of using an integrated interlock device of an air circuit breaker, including: connecting a first arm of a first circuit breaker with a third arm of a second circuit breaker by a first cable, connecting a second arm of the first circuit breaker with a door lever of the first circuit breaker by a second cable, connecting a third arm of the first circuit breaker with a first arm of the second circuit breaker by a third cable, connecting the second arm of the first circuit breaker with a switch lever of an MOC switch of the first circuit breaker by a fourth cable, connecting the third arm of the first circuit breaker with an opening lever of the first circuit breaker by a fifth cable, connecting a second arm of the second circuit breaker with a door lever of the second circuit breaker by a sixth cable, connecting the second arm of the second circuit breaker with a switch lever of an MOC switch of the second circuit breaker by a seventh cable, and connecting the third arm of the second circuit breaker with an opening lever of the second circuit breaker by an eighth cable; and turning on the second circuit breaker to rotate a bi-directional lever of the second circuit breaker, pulling the third cable by downward-moving the first arm of the second circuit breaker, and turning off the first circuit breaker by downward-moving the third arm of the first circuit breaker.

The method may further include pulling the sixth cable by upward-moving the second arm of the second circuit breaker, and preventing a switchboard door of the second circuit breaker from being open by rotating the door lever of the second circuit breaker and locking the door lever of the second circuit breaker to a restriction plate of the second circuit breaker.

The method may further include pulling the seventh cable by upward-moving the second arm of the second circuit breaker, and turning on the MOC switch of the second circuit breaker.

The method may further include rotating the opening lever of the first circuit breaker by opening a switchboard door of the first circuit breaker, pulling the fifth cable by the opening lever of the first circuit breaker, and turning off the first circuit breaker by downward-moving the third arm of the first circuit breaker.

In the integrated interlock device of an air circuit breaker and the method of using the same according to an embodiment of the present invention, various interlock functions may be utilized in a plurality of circuit breakers connected to each other.

In addition, since the interlock functions are used by using cables, they may be applied to two or more remotely-installed circuit breakers irrespective of an installation place or a position of components.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE INVENTION

Description will now be given in detail of preferred configurations of the present invention, with reference to the accompanying drawings.

Figure 1:
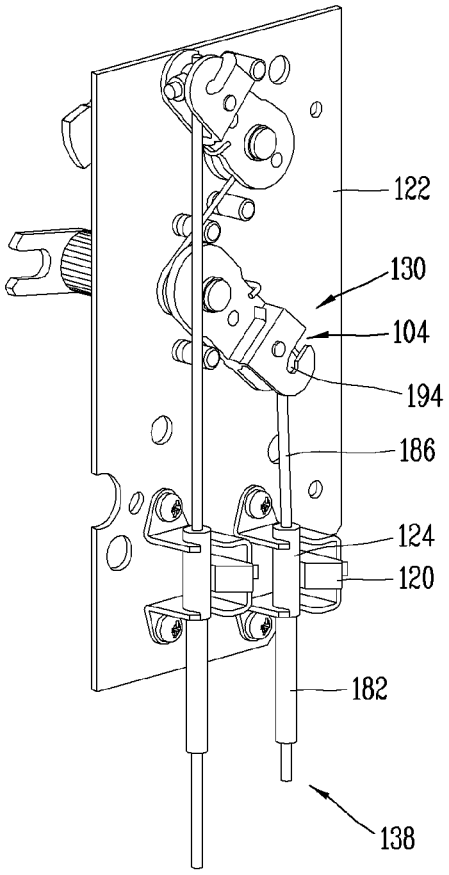
FIG. 1 PRIOR ART
FIG. 1 is a perspective view of an interlock device according to the conventional art.
Figure 2:
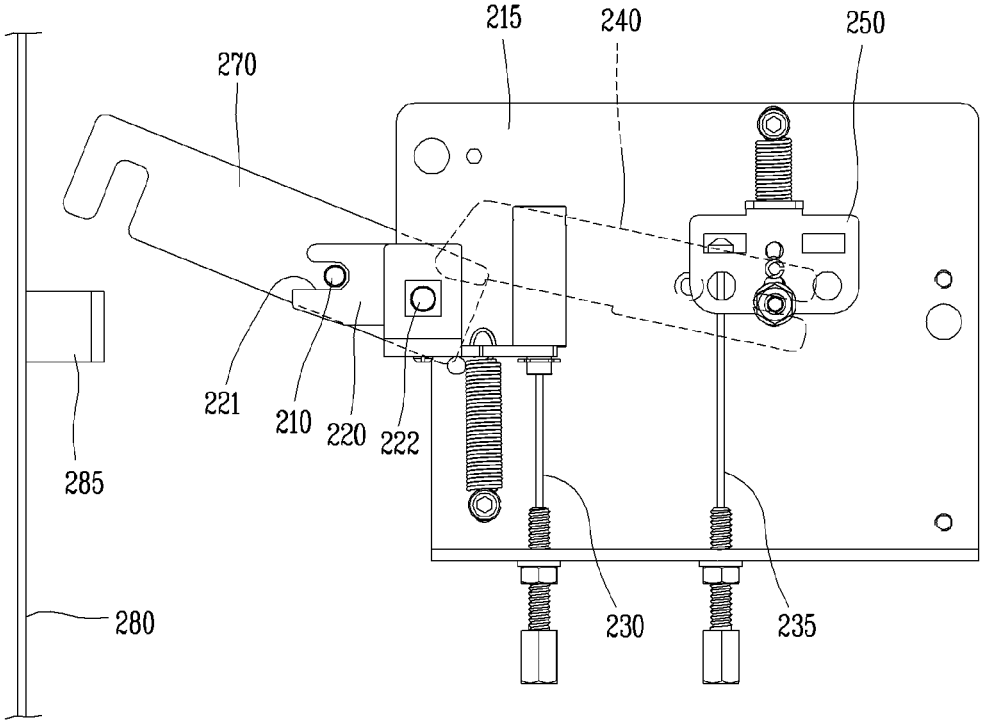
FIG. 2 PRIOR ART
FIG. 2 is a planar view of an interlock device according to another conventional art.
Figure 3:
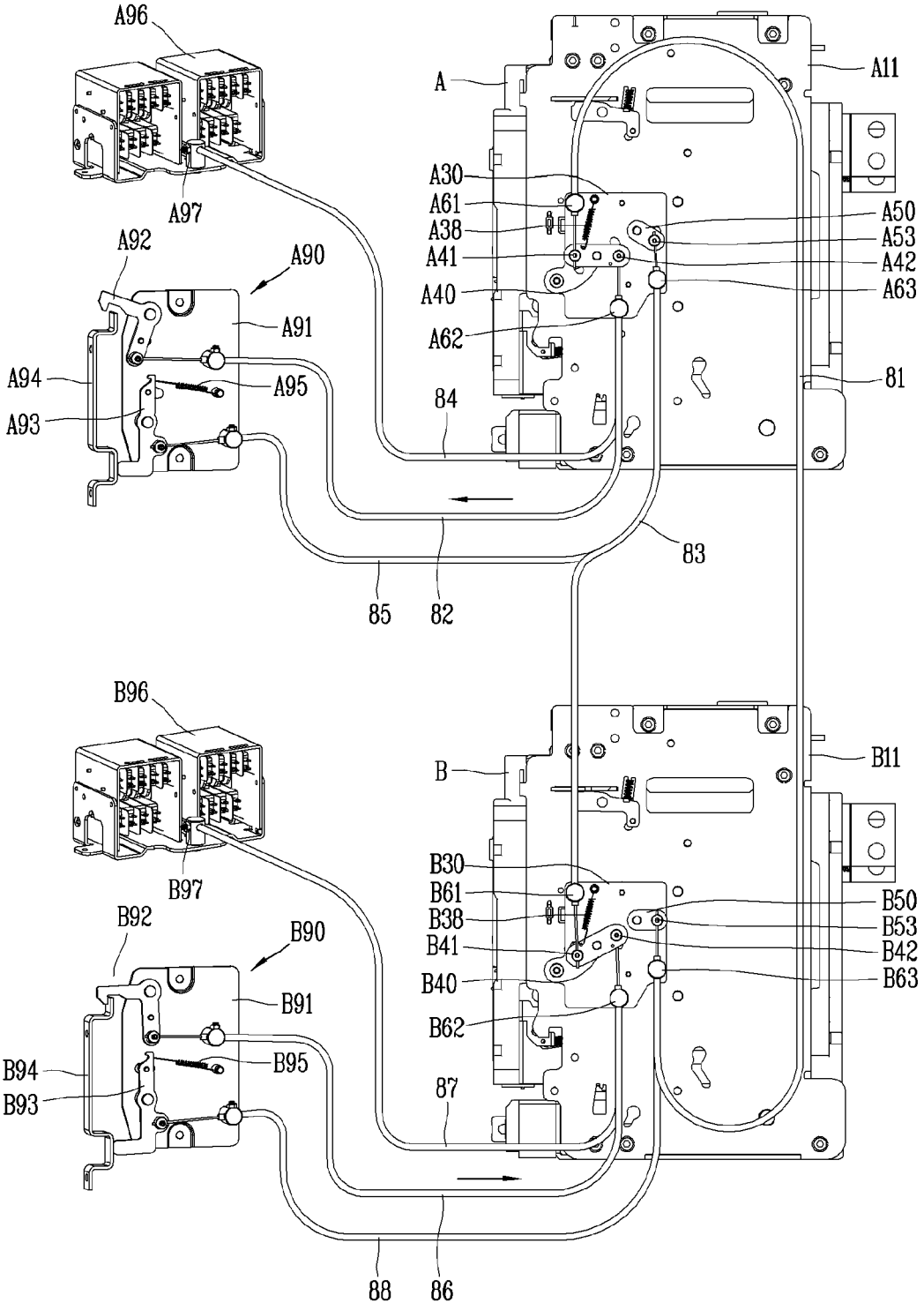
FIG. 3 is a configuration view illustrating that an integrated interlock device of an air circuit breaker is applied to two circuit breakers, according to an embodiment of the present invention.
Figure 4:
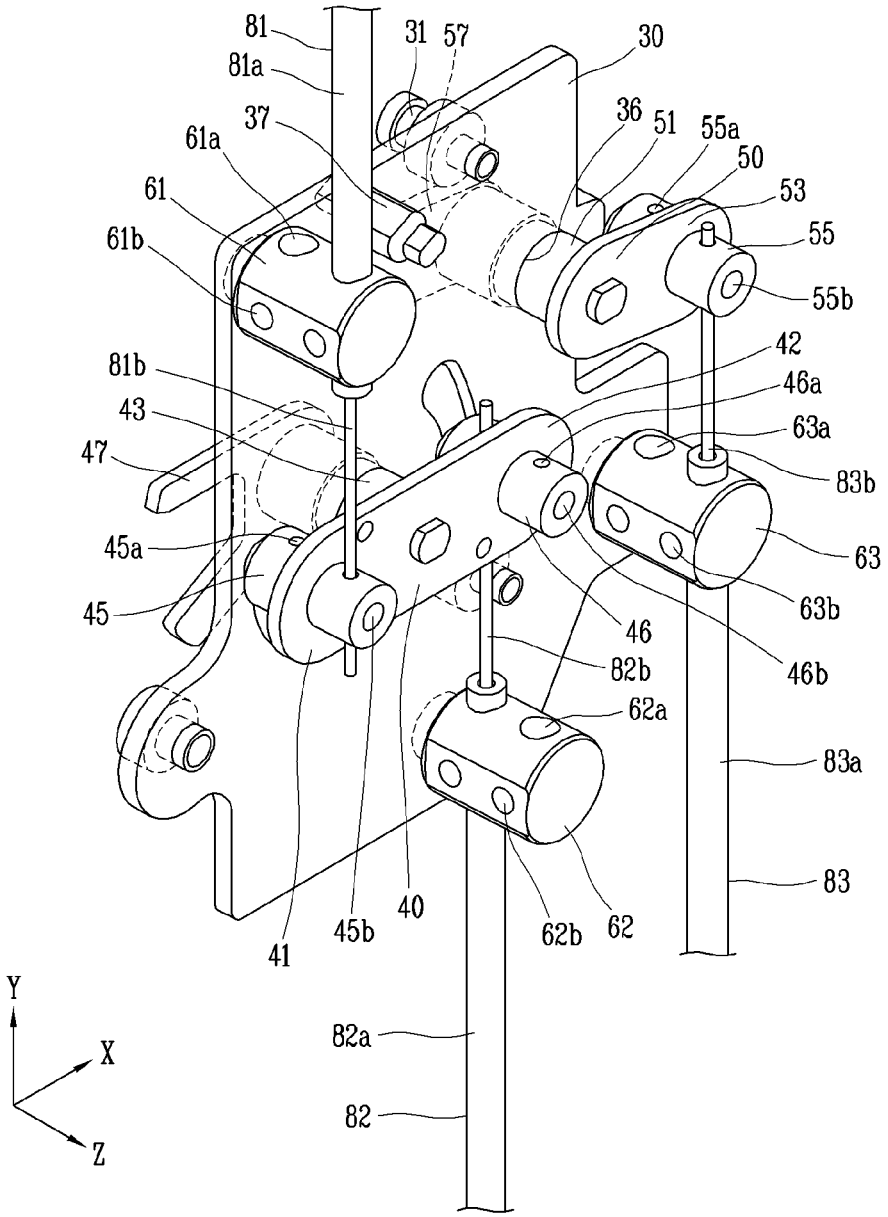
FIG. 4 is a perspective view of an integrated interlock device of an air circuit breaker according to an embodiment of the present invention.
Figure 5:
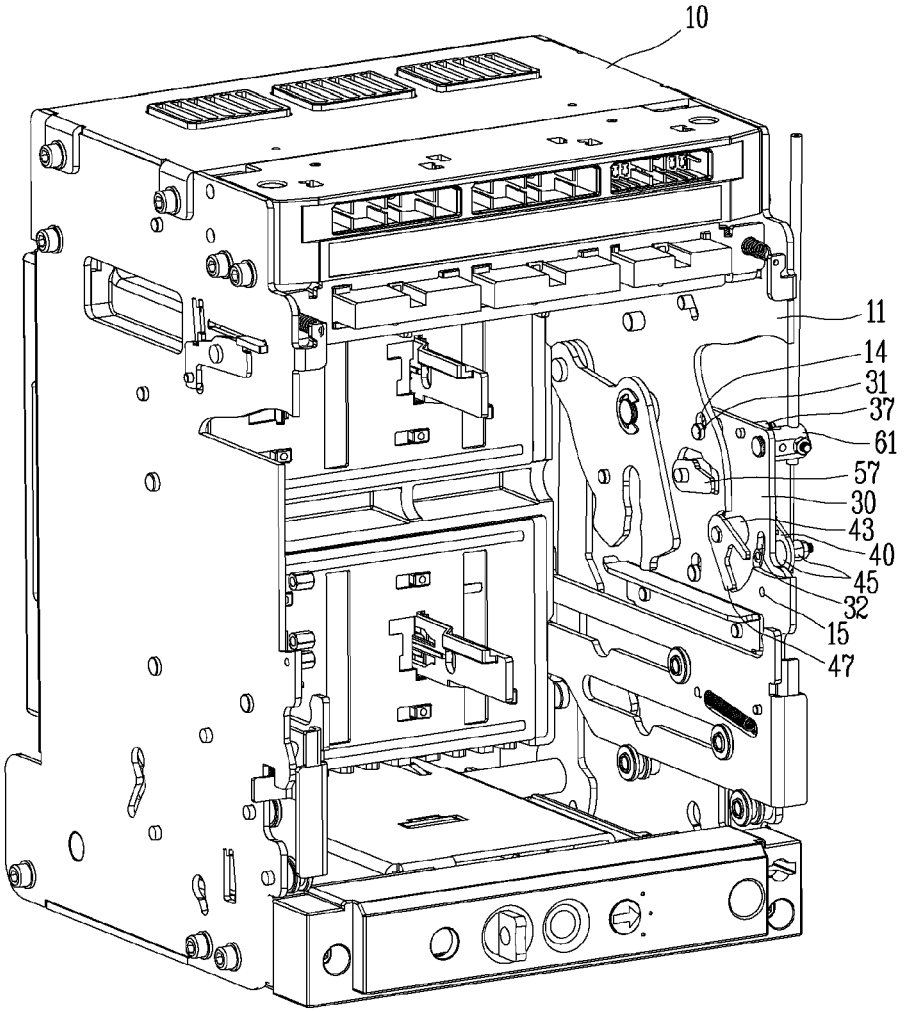
FIG. 5 is a perspective view illustrating a state that an integrated interlock device of an air circuit breaker has been mounted to a cradle, according to an embodiment of the present invention.
Figure 6:
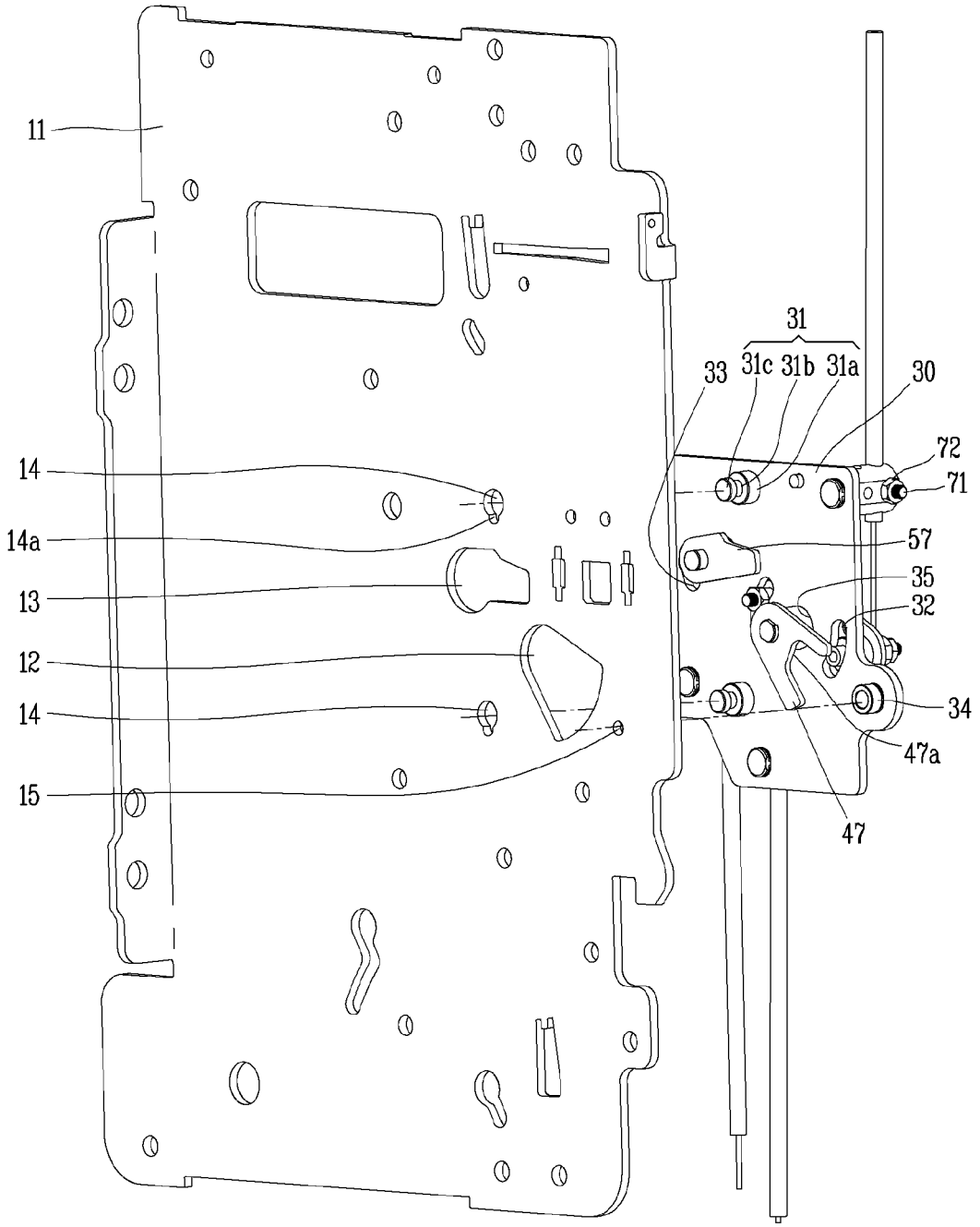
FIG. 6 is a disassembled perspective view of the integrated interlock device of an air circuit breaker and a side plate of the cradle of FIG. 5.

FIG. 3 is a configuration view illustrating that an integrated interlock device of an air circuit breaker is applied to two circuit breakers, according to an embodiment of the present invention. FIG. 4 is a perspective view of an integrated interlock device of an air circuit breaker according to an embodiment of the present invention. FIG. 5 is a perspective view illustrating a state that an integrated interlock device of an air circuit breaker has been mounted to a cradle, according to an embodiment of the present invention. FIG. 6 is a disassembled perspective view of the integrated interlock device of an air circuit breaker and a side plate of the cradle of FIG. 5. And FIG. 7 is a perspective view of a circuit breaker body to which an integrated interlock device of an air circuit breaker according to an embodiment of the present invention is applied.

Hereinafter, an integrated interlock device of an air circuit breaker according to an embodiment of the present invention will be explained with reference to the attached drawings.

The integrated interlock device of an air circuit breaker according to an embodiment of the present invention includes: a mounting plate 30 installed at part of a cradle 10 or a switchboard (not shown); a bi-directional lever 40 rotatably installed at the mounting plate 30, having a first arm 41 and a second arm 42 which are toward different directions on the basis of a first rotation shaft 43, and moved in a connected state to a main shaft of a circuit breaker body 20; a uni-directional lever 50 rotatably installed at the mounting plate 30 in a spaced state from the bi-directional lever 40, having a third arm 53 which is toward one direction on the basis of a second rotation shaft 51, and moved in a connected state to an off lever of the circuit breaker body 20; first to third cables 81, 82, 83 including sheaths 81*a*,82*a*,83*a* and core members 81*b*,82*b*,83*b*, and configured to transmit a power in a connected state to the first to third arms 41,42,53, respectively; and first to third connection openings 61,62,63 spaced from the first to third arms 41,42,53, and configured to fix the sheaths 81*a*,82*a*,83*a* of the first to third cables 81,82,83, respectively.

Figure 7:
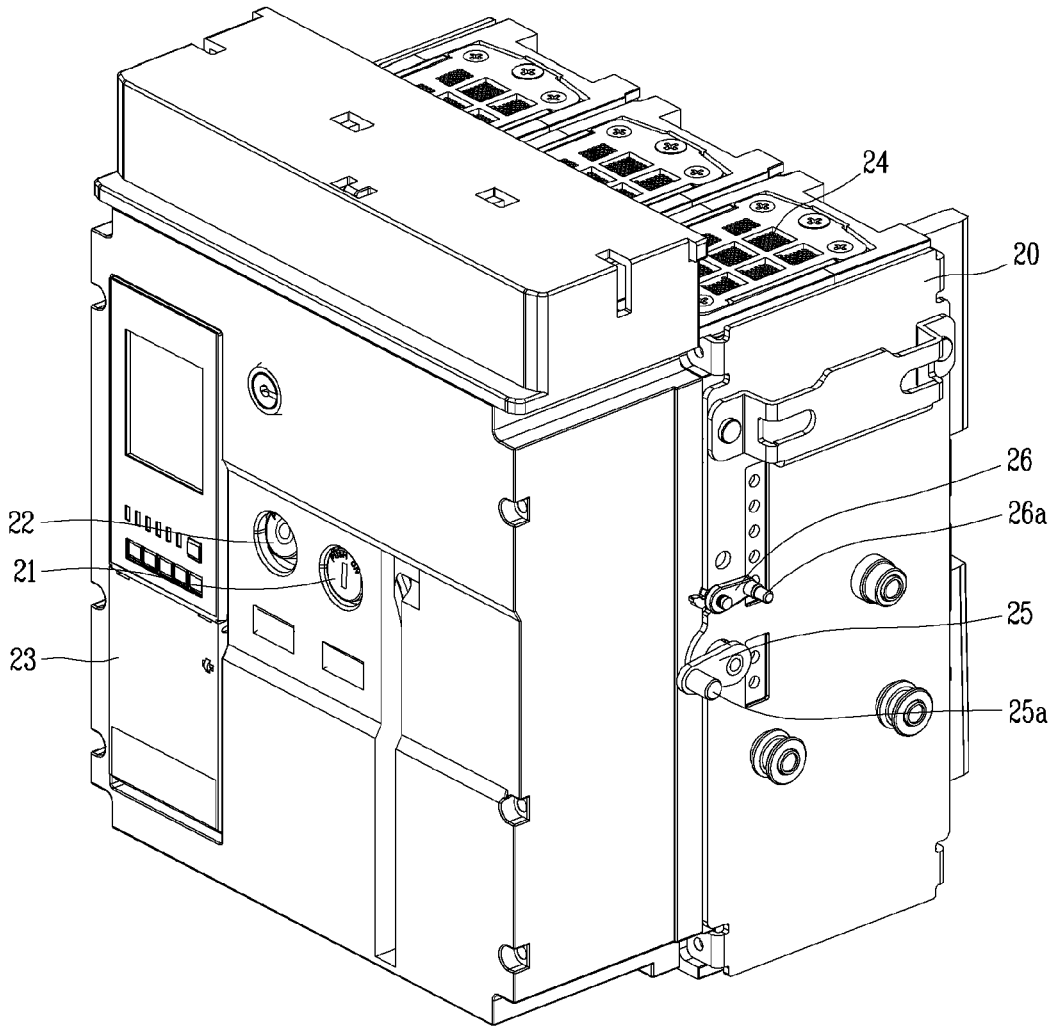
FIG. 7 is a perspective view of a circuit breaker body to which an integrated interlock device of an air circuit breaker according to an embodiment of the present invention is applied.

FIG. 7 illustrates a perspective view of the circuit breaker body 20. A switching mechanism, an extinguishing unit, etc. may be provided in the circuit breaker body 20. On and off buttons 21,22 for closing and interrupting operations, and an overcurrent relay 23 configured to transmit a trip signal after detecting an abnormal current may be provided on a front surface of the circuit breaker body 20. Arc chutes 24 which constitute the extinguishing unit are partially exposed to a region above the circuit breaker body 20.

A shaft lever 25 which is rotated by being interworked with a main shaft of the switching mechanism, and an off lever 26 configured to generate an interrupting operation at the switching mechanism by an interlock function are provided on a side surface of the circuit breaker body 20.

Referring to FIGS. 5 and 6, FIG. 5 illustrates part of a side plate 11 of a cradle 10 in a cut-out state. The cradle 10 is provided to accommodate the circuit breaker body 20 therein. The cradle 10 may be formed in a box shape having an open front surface. The integrated interlock device of an air circuit breaker according to an embodiment of the present invention may be installed at the side plate 11 of the cradle 10. For this, assembly holes 14 and first and second insertion holes 12, 13 may be formed. The assembly holes 14 are for assembly of the mounting plate 30. The mounting plate 30 may be simply coupled to the side plate 11 by inserting mounting pins 31 of the mounting plate 30 into the assembly holes 14. Fixing grooves 14*a* are concavely formed below the assembly holes 14, thereby fixing and supporting the mounting pins 31.

A locking lever 47 and a transmission lever 57 provided on a rear surface of the mounting plate 30 are inserted into a first insertion hole 12 and a second insertion hole 13, respectively, thereby being connected to the shaft lever 25 and the off lever 26 provided at one side of the circuit breaker body 20.

A coupling screw hole 15 may be provided at part of the side plate 11, thereby fixedly-coupling the mounting plate 30 thereto by a screw coupling.

The integrated interlock device of an air circuit breaker according to an embodiment of the present invention will be explained with further reference to FIG. 6.

The mounting plate 30 may be formed as a flat member. The mounting plate 30 may be installed at part of the cradle 10 or a distributing box. The mounting plate 30 may be installed at the side plate 11 of the cradle 10. For installation of the mounting plate 30, the plurality of mounting pins 31 may be provided on a rear surface of the mounting plate 30. The mounting pins 31 may be formed in a pillar shape having a three-end structure including a circumferential groove portion and a circumferential protrusion portion. The mounting pin 31 may include a supporting portion 31*a* formed at a lower end thereof, a fixing portion 31*b* formed at an intermediate part thereof, and an inserting portion 31*c* formed at an upper end thereof. Here, a diameter size of the supporting portion 31*a* is the largest, and a diameter size of the fixing portion 31*b* is the smallest (supporting portion 31*a*>inserting portion 31*c*>fixing portion 31*b*). Accordingly, the inserting portion 31*c* is inserted into the assembly hole 14, and then the fixing portion 31*b* is fitted into the fixing groove 14*a*. It is preferable that a diameter of the assembly hole 14 is larger than that of the inserting portion 31*c*, but is smaller than that of the supporting portion 31*a*. With such a configuration, the mounting pin 31 may be easily fitted into the assembly hole 14, and the mounting pin 31 is stably fixed without moving in a front or rear direction when the fixing portion 31*b* is fitted into the fixing groove 14*a*. The mounting pin 31 may be pulled out only in an upper direction. The supporting portion 31*a* stably supports the mounting pin 31 outside the side plate 11, and forms a predetermined gap between the side plate 11 and the mounting plate 30. Accordingly, a predetermined space is formed on a rear surface of the mounting plate 30, for prevention of interference among various components.

The cables 81,82,83 may include sheaths 81*a*,82*a*,83*a* and core members 81*b*,82*b*,83*b*. The sheaths 81*a*,82*a*,83*a* may be formed of a material having a high flexibility and an insulation property, and the core members 81*b*,82*b*,83*b* may be formed of a material having a flexibility and a high strength (e.g., steel wire, etc.). The cables 81,82,83 are used for power transmission between a plurality of circuit breakers, or between a circuit breaker and other device (or component). The core members 81*b*,82*b*,83*b* may perform a sliding motion within the sheaths 81*a*,82*a*,83*a*. Each of the core members 81*b*,82*b*,83*b* is formed to have a longer length than each of the sheaths 81*a*,82*a*,83*a*, and is exposed to two ends of each of the sheaths 81*a*,82*a*,83*a*. By using a cable, a power may be transmitted to a circuit breaker or a device which is disposed at a remote distance.

A supporting ring portion 34 is provided at part of the mounting plate 30. The mounting plate 30 may be fixedly-coupled to the side plate 11 by a coupling means such as a screw coupled to the supporting ring portion 34 and the coupling screw hole 15. That is, the mounting plate 30 for mounting the mounting pins 31 inserted into the assembly holes 14 may be simply installed, and may be fixed by using a coupling means coupled to the supporting ring portion 34 and the coupling screw hole 15.

The mounting plate 30 is provided with first and second operation holes 32, 33 for operating core holders 45, 46, 55 by inserting part of the core holders 45, 46, 55. The first and second operation holes 32, 33 may be formed to have a circular arc shape. The first operation hole 32 may be provided in one pair symmetrical with each other on the basis of the first rotation shaft 43.

A first shaft hole 35 for inserting the first rotation shaft 43, and a second shaft hole 36 for inserting the second rotation shaft 51 are formed at the mounting plate 30.

A spring fixing portion 37 for installing a return spring 38 (refer to A38 of FIG. 3) in order to provide a restoration force to the bi-directional lever 40, may be provided at part of the mounting plate 30.

The bi-directional lever 40 and the uni-directional lever 50 are rotatably installed at the mounting plate 30. The bi-directional lever 40 and the uni-directional lever 50 are spaced from each other by a predetermined distance, for prevention of interference therebetween at the time of rotation.

The bi-directional lever 40 may be fixedly-installed at the first rotation shaft 43. The bi-directional lever 40 may be formed as a straight plate. The bi-directional lever 40 is formed to be perpendicular to the first rotation shaft 43. It is also possible that the bi-directional lever 40 is integrally formed with the first rotation shaft 43.

The bi-directional lever 40 includes a first arm 41 and a second arm 42 which are extended in opposite directions. The first and second arms 41, 42 may be integrally formed with the bi-directional lever 40. With such a configuration, when the bi-directional lever 40 is clockwise rotated, the first arm 41 is upward moved and the second arm 42 is downward moved.

Core holders 45, 46 for fixing the core members of the cables, respectively are provided at the first and second arms 41, 42. Here, the core holders 45, 46 are referred to as a first core holder 45 and a second core holder 46. Each of the core holders 45, 46 may be formed to have a cylindrical shape. Each of the core holders 45, 46 may be provided in one pair, and may be installed on two side surfaces of each of the first and second arms 41, 42. That is, the first core holder 45 may be provided on both side surfaces of the first arm 41. The same applies to the second arm 42. According to another embodiment, each of the core holders 45, 46 may be formed as a single integrated opening, not a pair of openings. In this case, the core holders 45, 46 are penetratingly-installed at the arms 41, 42 of the bi-directional lever 40.

Core holes 45*a*, 46*a* for inserting the core members 81*b*, 82*b* of the cables 81, 82 are penetratingly-formed at the core holders 45,46. The core holes 45*a*,46*a* are preferably formed to be perpendicular to a lengthwise direction of the bi-directional lever 40. That is, the core holes 45*a*,46*a* are formed in upper and lower directions (y-axis direction) in the drawings. If each of the core holders 45, 46 is formed as a single opening not a pair of openings, two core holes 45*a*, 46*a* are formed.

Core fixing holes 45*b*, 46*b* are formed in a direction perpendicular to the core holes 45*a*, 46*a*, at one side of the core holes 45*a*,46*a*, i.e., in a direction perpendicular to the mounting plate 30 (z-axis direction). The core fixing holes 45*b*, 46*b* are provided to couple thereto a coupling means for fixing the core members 81*b*, 82*b*.

The locking lever 47 is coupled to a rear end of the first rotation shaft 43. The locking lever 47 is operated in a connected state to the shaft lever 25. The locking lever 47 is provided with a locking groove 47*a* for locking a protrusion 25*a* of the shaft lever 25. When the locking lever 47 is rotated, the bi-directional lever 40 coupled to a front end of the first rotation shaft 43 is rotated together. Since the locking lever 47 is rotated according to an 'on' operation and an 'off' operation of the circuit breaker body 20, an operation associated with the 'on' operation or the 'off' operation may be transmitted.

The uni-directional lever 50 is rotatably installed at the mounting plate 30 at a position spaced from the bi-directional lever 40 by a predetermined distance. The uni-directional lever 50 is installed at a front end of the second rotation shaft 51. The second rotation shaft 51 is inserted into the second shaft hole 36.

The uni-directional lever 50 is provided with a third arm 53 which is toward one direction. The third arm 53 may be provided at one side of the uni-directional lever 50. The third arm 53 may be integrally formed with the uni-directional lever 50.

A transmission lever 57 is coupled to a rear end of the second rotation shaft 51. The transmission lever 57 may be installed in a direction opposite to the uni-directional lever 50. That is, if the third arm 53 of the uni-directional lever 50 protrudes toward an (+) x axis direction, the transmission lever 57 may be towards a (−) x direction. The transmission lever 57 is operated in a connected state to the off lever 26 of the circuit breaker body 20. That is, when the uni-directional lever 50 is rotated, the transmission lever 57 is rotated through the second rotation shaft 51, and the transmission lever 57 may interrupt the circuit breaker body 20 by operating the protrusion 26*a* of the off lever 26.

The third arm 53 of the uni-directional lever 50 is provided with a pair of third core holders 55, and the third core holders 55 are provided with a core hole 55*a* and a core fixing hole 55*b*. The third core holders 55, the core hole 55*a* and the core fixing hole 55*b* are the same as or similar to the core holders 45, 46 of the bi-directional lever 40, and thus detailed explanations thereof will be omitted.

Connectors 61, 62, 63 are provided at positions spaced from the core holders 45, 46, 55 of the bi-directional lever 40 and the uni-directional lever 50 by predetermined distances, respectively. The connectors 61, 62, 63 are provided to fix the sheaths 81*a*, 82*a*, 83*a* of the cables 81, 82, 83. The connectors 61, 62, 63 may fix end parts of the sheaths 81*a*, 82*a*, 83*a*.

A first connector 61 is provided at one side of the first core holder 45, and a third connector 63 is provided at one side of the third core holder 55. Here, the first connector 61 and the second connector 62 may be located in opposite directions. In other words, in the drawings, the first connector 61 may be positioned above the first core holder 45 in an y-axis, and the second connector 62 may be positioned below the second core holder 46 in an y-axis. Accordingly, the first cable 81 and the second cable 82 may be operated in opposite directions.

The connectors 61, 62, 63 will now be described in more detail. For example, the first connector 61 will be described. A cable hole 61*a* for inserting a cable thereinto is formed at the first connector 61. The cable hole 61*a* is preferably formed in an up-down direction (y-axis direction) like the core hole 45*a*. The cable holes 61*a* are formed as a pair. Here, it is preferable that the pair of cable holes 61*a* are formed at a position linearly connected to the core hole 45*a*. An end part of the sheath 81*a* is inserted into the first connector 61.

A sheath fixing hole 61*b* is formed at one side of the cable hole 61*a* in a direction perpendicular to the cable hole 61*a* (x-axis direction). The sheath fixing hole 61*b* is provided to couple thereto a coupling means for fixing the sheath 81*a*.

The above description of the first connector 61 is equally applied to the second connector 62 and the third connecting port 63.

The sheaths 81*a*, 82*a*, 83*a* of the cables 81, 82, 83 are fixed by the connectors 61, 62, 63, and the core members 81*b*, 82*b*, 83*b* coupled to the core holders 45, 46, 55 are moved as the bidirectional lever 40 or the uni-directional lever 50 moves.

Provided are coupling means inserted into the core fixing holes 45*b*, 46*b*, 55*b* to fix the core members 81*b*, 82*b*, 83*b*, and coupling means inserted into the sheath fixing holes 61*b*, 62*b*, 63*b* to fix the sheaths 81*a*, 82*a*, 83*a*. The coupling means may include a bolt 71 and a nut 72 (refer to FIG. 6).

Each of the arms 41,42,53 is provided with a pair of core holes 45*a*,46*a*,55*a*, respectively, and each of the connectors 61,62,63 is provided with a pair of cable holes 61*a*,62*a*,63*a*, respectively. Thus, a pair of cables may be installed at each of the arms 41,42,53 to thus be utilized for an interlock function.

A door interlock device will be explained with reference to FIG. 3. A door interlock device (A90) of a first circuit breaker (A) includes a door lever (A92) rotatably installed at a door interlock plate (A91) and configured to restrict a switchgear door from being open; and an opening lever (A93) that operates in an interworking manner when the switchboard door is open. One end of the door lever (A92) may be rotated in a connected state to a cable, and the other end thereof may be provided with a hook so as to be locked by a restriction plate (A94) coupled to the switchgear door to prevent opening of the switchgear door.

When the switchboard door is closed, one end of the opening lever (A93) is in contact with the restriction plate (A94), and another end of the opening lever (A93) is connected to an operation spring (A95). However, when the switchboard door is open, the opening lever (A93) is rotated to pull a cable 85 connected to one end of the opening lever (A93).

An operation of the integrated interlock device of an air circuit breaker according to an embodiment of the present invention will be described. This is also a method of using the integrated interlock device of an air circuit breaker according to an embodiment of the present invention.

Figure 8:
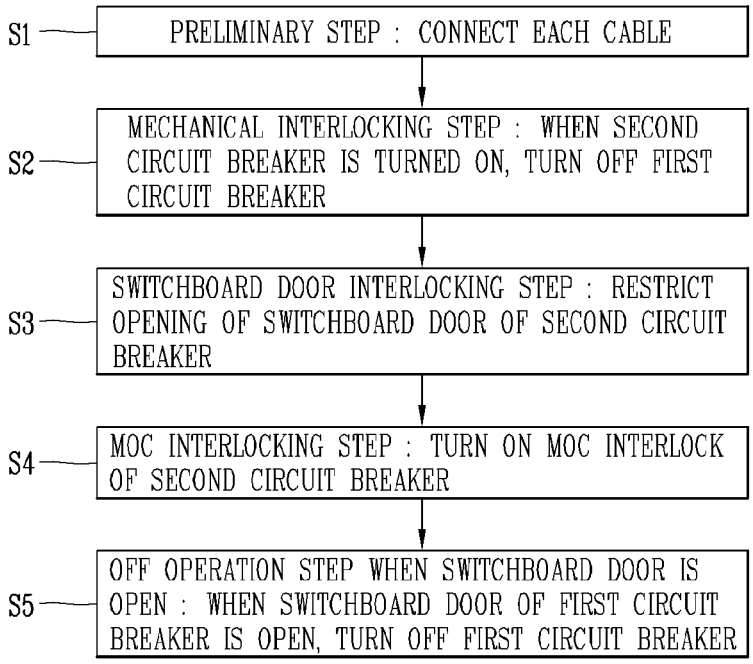
FIG. 8 is a block diagram illustrating a method of using an integrated interlock device of an air circuit breaker according to an embodiment of the present invention.

Referring to FIG. 8, the method of using the integrated interlock device of an air circuit breaker according to an embodiment of the present embodiment includes a preliminary step (S1), a mechanical interlocking step (S2), a switchboard door interlocking step (S3), an MOC interlocking step (S4), and an 'off' operation step (S5) when a switchgear door is open.

Here, the preliminary step (S1) may be a step of connecting each cable. The mechanical interlocking step (S2) may be a step of turning off another circuit breaker when one circuit breaker is turned on. The switchboard door interlocking step (S3) may be a step of preventing an open state of a switchboard door of the turned-on circuit breaker. The MOC interlocking step (S4) may be a step of turning on an MOC interlock of the turned-on circuit breaker. And the 'off' operation step (S5) when a switchgear door is open may be a step of turning off said another circuit breaker when a switchboard door of said another circuit breaker is open.

Each step will be described in detail. For example, referring to FIG. 3, a case where two circuit breakers are provided will be described. Here, a first circuit breaker (A) and a second circuit breaker (B) are provided. In order to distinguish components of the circuit breakers, 'A' is added to a front side of reference numerals of components of the first circuit breaker (A), and is added to a front side of reference numerals of components of the second circuit breaker (B). For example, the first arm of the first circuit breaker (A) is represented as 'A41' and the first arm of the second circuit breaker (B) is represented as 'B41'.

The preliminary step (S1) is a step of connecting each cable. A first cable 81 connects the first arm (A41) of the first circuit breaker (A) with the third arm (B53) of the second circuit breaker (B). A second cable 82 connects the second arm (A42) of the first circuit breaker (A) with the door lever (A92) of the first circuit breaker (A). A third cable 83 connects the third arm (A53) of the first circuit breaker (A) with the first arm (B41) of the second circuit breaker (B). A fourth cable 84 connects the second arm (A42) of the first circuit breaker (A) with a switch lever (A97) of an MOC switch (A96) of the first circuit breaker (A). A fifth cable 85 connects the third arm (A53) of the first circuit breaker (A) with the opening lever (A93) of the first circuit breaker (A). A sixth cable 86 connects the second arm (B42) of the second circuit breaker (B) with a door lever (B92) of the second circuit breaker (B). A seventh cable 87 connects the second arm (B42) of the second circuit breaker (B) with a switch lever (B97) of an MOC switch (B96) of the second circuit breaker (B). An eighth cable 88 connects the third arm (B53) of the second circuit breaker (B) with an opening lever (B93) of the second circuit breaker (B).

In such an installed state, a mechanical interlock function will be described. The mechanical interlocking step (S2) is a step of turning off another circuit breaker when one circuit breakers is turned on. A case where the second circuit breaker (B) is turned on will be described as an example. When the second circuit breaker (B) is turned on, a rotational force of the main shaft is transmitted via the shaft lever and the locking lever of the second circuit breaker (B), thereby rotating the bi-directional lever (B40) in a counterclockwise direction as shown in FIG. 3. Accordingly, the first arm (B41) of the second circuit breaker (B) is downward moved to pull one end of the third cable 83. Accordingly, the third arm (A53) of the first circuit breaker (A) connected to another end of the third cable 83 is downward moved to operate the off lever, such that the first circuit breaker (A) is turned off.

On the contrary, when the first circuit breaker (A) is turned on, the second circuit breaker (B) is turned off via the first arm (A41) of the first circuit breaker (A), the first cable 81, and the third arm (B53) of the second circuit breaker (B).

Next, a switchboard door interlock function will be explained. The switchboard door interlocking step (S3) is a step of preventing a switchboard door of the turned-on circuit breaker from being open. First, a case where a switchboard door interlock function is performed when the circuit breaker is turned on, will be described. When the second circuit breaker (B) is turned on, the second arm (B42) is upward moved. As a result, the sixth cable 86 is pulled, and the door lever (B92) of the second circuit breaker (B) is rotated in a counterclockwise direction, such that a hook is caught by the restriction plate (B94). Thus, opening of the switchboard door of the second circuit breaker (B) is prevented.

On the other hand, a case where the circuit breaker is turned off when a switchgear door is open will be described. This corresponds to the 'off' operation step (S5) when a switchgear door is open. That is, when a switchboard door of another circuit breaker is open, said another circuit breaker is turned off. When the switchboard door of the first circuit breaker (A) is open and the restriction plate (A94) is separated from the opening lever (A93), the opening lever (A93) is rotated in a clockwise direction by receiving a force of the operation spring (A95). Accordingly, the fifth cable 85 connected to one end of the opening lever (A93) is pulled, the third arm (A53) is downward moved, and the first circuit breaker (A) is turned off.

Next, an MOC interlock function will be explained. The MOC interlocking step (S4) may be a step of turning on an MOC interlock of the turned-on circuit breaker. As the second circuit breaker (B) is turned on, the second arm (B42) is upward moved, and the seventh cable 87 connected to the second arm (B42) is pulled such that the switch lever (B97) of the MOC switch 96 of the second circuit breaker (B) is pulled. As a result, the MOC switch (B96) is turned on.

On the other hand, as the first circuit breaker (A) is turned off, the second arm (A42) returns to its original position (horizontal state) by the return spring (A38). And the fourth cable 84 connected to the second arm (A42) is pushed to return the switch lever (A97) of the first circuit breaker (A). As a result, the MOC switch (A96) is turned off.

Although not shown, it is also possible to use three breakers connected to each other.

For a maximum utilization of an embodiment of the present invention, six cables may be connected to each circuit breaker, and various interlock functions may performed according to 'on' and 'off' operations.

In the integrated interlock device of an air circuit breaker according to an embodiment of the present invention, various interlock functions may be utilized in a plurality of circuit breakers connected to each other.

In addition, since the interlock functions are used by using cables, they may be applied to two or more remotely-installed circuit breakers irrespective of an installation place or a position of components.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. An integrated interlock device of an air circuit breaker, comprising:

a mounting plate installed at part of a cradle or a switchboard;

a bi-directional lever rotatably installed at the mounting plate, having a first arm and a second arm which are toward different directions on the basis of a first rotation shaft, and moved in a connected state to a main shaft of a circuit breaker body;

a uni-directional lever rotatably installed at the mounting plate in a spaced state from the bi-directional lever, having a third arm which is toward one direction on the basis of a second rotation shaft, and moved in a connected state to an off lever of the circuit breaker body; and first to third cables configured to transmit a power in a connected state to the first to third arms, respectively, wherein each of the first to third cables includes a sheath and a core member, and wherein each of the first to third arms is provided with a pair of core holders for fixing a pair of core members of each of the first to third cables.

2. The device of claim 1, further comprising first to third connection openings spaced from the first to third arms, and configured to fix the sheaths of the first to third cables, respectively.

3. The device of claim 2, wherein the first and second connection openings are spaced from each other in opposite directions, on the basis of the bi-directional lever.

4. The device of claim 2, wherein each of the first to third connection openings is provided with a pair of cable holes for fixing a pair of sheaths of each of the first to third cables.

5. The device of claim 4, wherein core holes for inserting the core members are penetratingly-formed at the core holders, and core fixing holes are formed at one side of the core holes in a direction perpendicular to the core holes.

6. The device of claim 5, wherein sheath fixing holes are penetratingly-formed at one side of the cable holes, in a direction perpendicular to the cable holes.

7. The device of claim 5, wherein coupling members are provided to fix the core members or the sheaths by being inserted into the core fixing holes or the sheath fixing holes.

8. The device of claim 7, wherein the coupling means includes a bolt and a nut.

9. The device of claim 1, wherein the mounting plate is provided with operation holes for operating the core holders by inserting part of the core holders.

10. An integrated interlock device of an air circuit breaker, comprising:

a mounting plate installed at part of a cradle or a switchboard;

a bi-directional lever rotatably installed at the mounting plate, having a first arm and a second arm which are toward different directions on the basis of a first rotation shaft, and moved in a connected state to a main shaft of a circuit breaker body;

a uni-directional lever rotatably installed at the mounting plate in a spaced state from the bi-directional lever, having a third arm which is toward one direction on the basis of a second rotation shaft, and moved in a connected state to an off lever of the circuit breaker body; and first to third cables configured to transmit a power in a connected state to the first to third arms, respectively, wherein a locking lever, rotated in a connected state to a shaft lever of the circuit breaker body, is provided on a rear surface of the bi-directional lever, and wherein a transmission lever, rotated in a connected state to the off lever of the circuit breaker body, is provided on a rear surface of the uni-directional lever.

11. The device of claim 10, wherein first and second insertion holes, configured to insert the locking lever and the transmission lever, respectively, are formed at a side plate of the cradle.

12. The device of claim 11, wherein a plurality of assembly holes for insertion-installation of the mounting plate are formed at the side plate, and mounting pins inserted into the assembly holes are provided on a rear surface of the mounting plate.

13. A method of using an integrated interlock device of an air circuit breaker, comprising:

connecting a first arm of a first circuit breaker with a third arm of a second circuit breaker by a first cable, connecting a second arm of the first circuit breaker with a door lever of the first circuit breaker by a second cable, connecting a third arm of the first circuit breaker with a first arm of the second circuit breaker by a third cable, connecting the second arm of the first circuit breaker with a switch lever of an MOC switch of the first circuit breaker by a fourth cable, connecting the third arm of the first circuit breaker with an opening lever of the first circuit breaker by a fifth cable, connecting a second arm of the second circuit breaker with a door lever of the second circuit breaker by a sixth cable, connecting the second arm of the second circuit breaker with a switch lever of an MOC switch of the second circuit breaker by a seventh cable, and connecting the third arm of the second circuit breaker with an opening lever of the second circuit breaker by an eighth cable; and turning on the second circuit breaker to rotate a bi-directional lever of the second circuit breaker, pulling the third cable by downward-moving the first arm of the second circuit breaker, and turning off the first circuit breaker by downward-moving the third arm of the first circuit breaker.

14. The method of claim 13, further comprising pulling the sixth cable by upward-moving the second arm of the second circuit breaker, and preventing a switchboard door of the second circuit breaker from being open by rotating the door lever of the second circuit breaker and locking the door lever of the second circuit breaker to a restriction plate of the second circuit breaker.

15. The method of claim 14, further comprising pulling the seventh cable by upward-moving the second arm of the second circuit breaker, and turning on the MOC switch of the second circuit breaker.

16. The method of claim 15, further comprising rotating the opening lever of the first circuit breaker by opening a switchboard door of the first circuit breaker, pulling the fifth cable by the opening lever of the first circuit breaker, and turning off the first circuit breaker by downward-moving the third arm of the first circuit breaker.

* * * * *